US005158008A

United States Patent [19]

Ripberger et al.

[11] Patent Number: 5,158,008

[45] Date of Patent: Oct. 27, 1992

[54] LIGHT PLUNGER PISTON FOR INTERNAL COMBUSTION ENGINES

[75] Inventors: Emil Ripberger, Remseck; Jürgen Ellermann, Winnenden, both of Fed. Rep. of Germany

[73] Assignee: Mahle GmbH, Stuttgart, Fed. Rep. of Germany

[21] Appl. No.: 688,583

[22] PCT Filed: Nov. 29, 1989

[86] PCT No.: PCT/DE89/00745

§ 371 Date: Jun. 24, 1991

§ 102(e) Date: Jun. 24, 1991

[87] PCT Pub. No.: WO90/07642

PCT Pub. Date: Jul. 12, 1990

[30] Foreign Application Priority Data

Dec. 24, 1988 [DE] Fed. Rep. of Germany ..... 3843761
Dec. 24, 1988 [DE] Fed. Rep. of Germany ..... 3843866

[51] Int. Cl.[5] ..... F16J 1/00

[52] U.S. Cl. ..... 92/177; 92/208; 92/222; 92/225; 92/228; 92/227; 92/230; 92/233; 92/234; 92/235; 123/193.6

[58] Field of Search ..... 92/177, 208, 222, 225, 92/226, 227, 228, 229, 230, 233, 234, 235; 123/193 P

[56] References Cited

U.S. PATENT DOCUMENTS

| | | | |
|---|---|---|---|
| 1,499,073 | 6/1924 | Pomeroy | 92/235 X |
| 3,908,521 | 9/1975 | Cockcroft | 92/225 X |
| 4,669,366 | 6/1987 | Ellermann et al. | 92/225 |
| 4,704,950 | 11/1987 | Ripberger et al. | 92/208 |
| 4,716,817 | 1/1988 | Ripberger et al. | 92/233 X |
| 4,831,919 | 5/1989 | Bruni | 92/233 |
| 5,000,078 | 3/1991 | Gabele | 92/228 |
| 5,048,398 | 9/1991 | Pfeiffenberger et al. | 92/208 X |

FOREIGN PATENT DOCUMENTS

| | | | |
|---|---|---|---|
| 211189 | 2/1987 | European Pat. Off. . | |
| 209006 | 4/1987 | European Pat. Off. . | |
| 3820473 | 12/1989 | Fed. Rep. of Germany | 123/193 P |
| 0157461 | 6/1990 | Japan | 123/193 P |
| 1256242 | 12/1971 | United Kingdom . | |
| 8808078 | 10/1988 | World Int. Prop. O. . | |

*Primary Examiner*—Edward K. Look
*Assistant Examiner*—Todd Mattingly
*Attorney, Agent, or Firm*—Collard & Roe

[57] ABSTRACT

A piston having a head with ring grooves, a skirt having hub bores, and a pin, with the following dimensions:

L/D=0.45–0.8
H/D=0.25–0.5
A/D=0.3–0.5
T/D=0.45–0.8 where

L=maxium length of the piston
D=maximum diameter of the piston
H=compression height
A=maximum skirt height below the bottom ring groove in a peripheral area having the approximate same skirt height of at least 45 degrees on the major thrust face of the piston with approximately symmetrical division of this area on both sides of a plane extending perpendicular to the pin axis and passing through the longitudinal axis of the piston,
T=diametrically opposite distance between the hub bore ends located radially on the outside.

The skirt bulges along the axis of the piston and has an oval cross-section. An axis of the hub bores is offset slightly towards the major thrust face. The piston includes a horizontal slit, which separates the head from the skirt. In a polar plane perpendicular to the piston axis the skirt has a greater ovality on the minor thrust face. The minor thrust face side of the skirt is structured to bulge less in its upper area, adjacent to the bottom ring groove. The skirt is longer on the major thrust face. The wall thickness is greater on the major thrust face.

3 Claims, 3 Drawing Sheets

LIGHT PLUNGER PISTON FOR INTERNAL COMBUSTION ENGINES

BACKGROUND OF THE INVENTION

1. Field of the Invention

The invention relates to a light plunger piston for internal combustion engines.

It is the object of the invention to improve the noise characteristics of such a piston during engine operation, with the lowest possible weight and smallest possible dimensions. At the same time, the piston is supposed to produce the least possible friction losses during engine operation.

2. Description of the Prior Art

A piston is known from WO 88/08078. The solution path striven for there, however, will not be taken by the present invention.

The solution with the piston according to WO 88/08078 consists of allowing the piston to run at an angle relative to its piston head in operating states at which the piston has not yet reached the temperature which prevails in its rated performance operation. For this purpose, the piston shaft or skirt is provided with a corresponding contour, which changes with an increasing operating temperature of the piston, in that the piston head is aligned parallel to the engine cylinder axis during rated performance operation of the piston. The slanted position of the piston head at lower temperatures, which exists during partial load operation of the engine, is aimed at so that the piston head can be held as far away as possible from the cylinder wall on that side on which it tends to hit against the cylinder wall as the result of its tilt movement. The risk of an impact against the cylinder wall particularly exists on the counterpressure side or minor thrust face, and for this reason, the piston head is angled in such a way that there is a greater distance between the top land and the cylinder wall on the counterpressure side or minor thrust face than on the pressure side or major thrust face.

The slit below the bottom piston ring groove is provided on the minor thrust face in this known piston, in order to interrupt the heat flow from the hot piston head to the skirt area below it, on that side. Such an interruption of the heat flow is necessary so that the skirt undergoes as little expansion radially towards the outside as possible, due to heat, at its upper end. A control strip additionally applied to the upper end of the skirt on the minor thrust face in this known piston, which has a lower coefficient of expansion as compared with the skirt material, also serves to prevent such an excessive radial expansion. With the combined measure of the slit and the heat-expansion-damping control strip, it is possible with this piston to create a skirt contour change in the direction of the rod swing plane (plane in which the piston axis extends and stands perpendicular to the piston pin axis) on the minor thrust face, which moves the piston head into a position parallel to the cylinder axis with an increasing piston temperature.

The result which can be achieved with this embodiment is to be further improved with a piston embodiment according to the invention.

SUMMARY OF THE INVENTION

It is, therefore, an object of the present invention to overcome the afore-mentioned drawbacks of the prior art and to provide a piston with improved noise characteristics.

It is a further object of the present invention to provide such a piston which has the lowest possible weight and smallest possible dimensions.

It is still a further object of the present invention to provide such a piston which produces the least possible friction losses during engine operation.

These and other objects are achieved by a light plunger piston for internal combustion engines, especially gasoline engines for passenger automobiles, including a piston having a head with ring grooves, a skirt having hub bores and a pin. The piston has the following dimensions $L/D=0.45–0.8$ $H/D=0.25–0.5$ $A/D=0.3–0.5$ $T/D=0.45–0.8$ where

L=maximum length of the piston

D=maximum diameter of the piston

H=compression height

A=maximum skirt height below the bottom ring groove in a peripheral area having the approximate same skirt height of at least 45 degrees on the major thrust face of the piston with approximately symmetrical division of this area on both sides of a plane extending perpendicular to the pin axis and passing through the longitudinal axis of the piston, T=diametrically opposite distance between the hub bore ends located radially on the outside.

The skirt bulges along the axis of the piston and has an oval cross-section, with the large diameter of the oval oriented perpendicular to the pin axis. An axis of the hub bores is offset slightly towards the major thrust face. The piston includes a horizontal slit, which separates the head from the skirt, located on the minor thrust face side of a plane extending through the longitudinal axis of the pin and the piston.

In a polar plane perpendicular to the piston axis the skirt has greater ovality on the minor thrust face side than on the major thrust face side. The minor thrust face side of the skirt is structured to bulge less in its upper area, adjacent to the bottom ring groove, than in the major thrust face. The skirt is longer on the major thrust face than on the minor thrust face. The wall thickness of the piston on the major thrust face is greater than on the minor thrust face.

The piston may also include an expansion controlling insert located in the area of the minor thrust face. The insert is formed as strip extending in the direction of the skirt periphery and has a heat expansion coefficient which is less than that of the skirt. An insert may also be located in the area of the major thrust face having a greater distance from the upper end of the skirt than the insert located in the area of the minor thrust face.

With the measures according to the invention, the piston skirt is structured slightly more resilient radially, overall, on the minor thrust face than on the major thrust face. In this way, the movement play relative to the cylinder contact surface can be selected to be less on the minor thrust face than on the major thrust face. The skirt which is longer on the major thrust face than on the minor thrust face has the following effects during engine operation:

At the upper slack point, a tilt momentum occurs due to offsetting of the pin axis towards the major thrust face, causing the piston to come into contact with the cylinder on the minor thrust face at its top land. The longer skirt prevents such contact of the top land by reducing the tilt angle, and thereby prevents an increase in piston noise.

From the state of the art, a piston is known from EP-A-0211189, the skirt of which can be structured asymmetrically, as desired, overall. However, the goal according to the invention does not require asymmetrical skirt structure, and it is certainly not accomplished in comparable manner. In particular, the piston there does not have any horizontal slit between the piston head and skirt on the minor thrust face. Such a slit is absolutely necessary, however, to achieve the result according to the invention.

A piston described in EP-A-0209006, in which the ovalities of the skirt are structured differently on the major thrust face and the minor thrust face, is also not comparable with the piston according to the invention, because there is no combination of characteristics comparable with the invention in that case.

BRIEF DESCRIPTION OF THE DRAWINGS

An embodiment of the invention is shown in the drawings. These show.

DESCRIPTION OF THE PREFERRED EMBODIMENT

Figure 1:
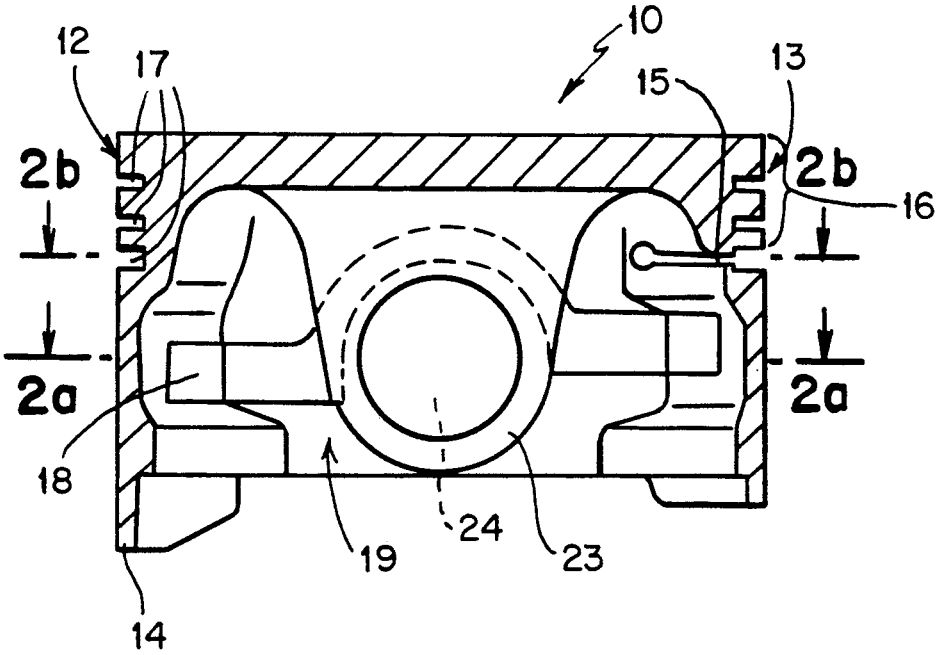
FIG. 1, a piston in longitudinal cross-section.

Referring to the drawings, and in particular FIG. 1, there is shown a piston 10 with a skirt 11 and a piston head 16 with ring grooves 17. Piston 10 has a longer skirt 11 on the major thrust face DS 12 than on the minor thrust face GDS 13. In addition, the thickness of a wall 14 of skirt 11 is greater on major thrust face DS 12 than on minor thrust face DES 13. A horizontal slit 15 on minor thrust face GDS 13 within the bottom ring groove 17 separates skirt 11 from piston head 16. Slit 15 and the lesser wall 14 thickness of skirt 11 ensure a certain elastic resilience on minor thrust face GDS 13, while this resilience is not supposed to be present on major thrust face 12.

Figure 2A:
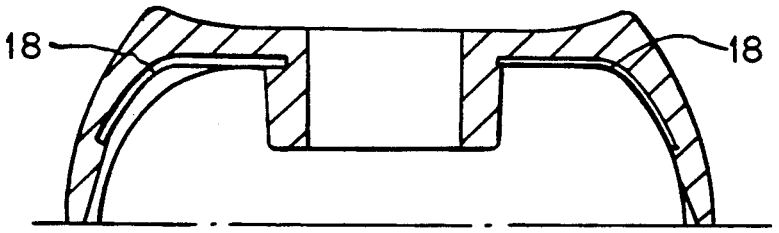
FIGS. 2*a, b*, the piston in cross-section along the line IIa and IIb, respectively, FIG. 3, a view of another piston, FIG. 4, the mantle line progression of the piston according to FIG. 3 in the major-minor thrust face direction as well as in the pin direction, on the major thrust face of the piston in each case, FIG. 5, the mantle line progression of the piston according to FIG. 3 in the major-minor thrust face direction as well as in the pin direction, on the minor thrust face of the piston in each case, FIG. 6, a cross-section through the piston along the line VI—VI in FIG. 3, FIG. 7, the shaft circumference progression at the levels X and Y, as curves X, Y plotted above one another in each case, in exaggerated representation of the piston according to FIG. 3.
Figure 2B:
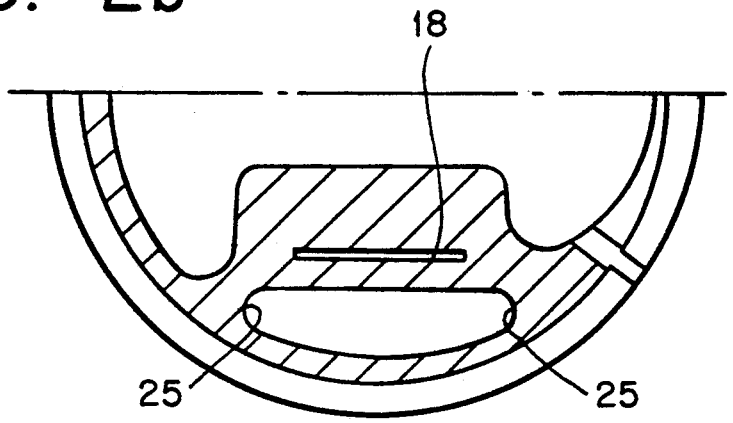

Control strips 18 inserted in interior 19 of piston skirt 11 of piston 10 according to FIG. 1 allow a closer guidance of skirt 11 on the cold state of piston 10. Since the arrangement of control strips 18 is provided to be closer to the upper end of skirt 11 on minor thrust face GDS 13 as compared with major thrust face DS 12, the play between the upper portion of skirt 11 and cylinder area can be adjusted to be less there in the cold state than it is in the corresponding area of skirt 11 on major thrust face DS 12. FIGS. 2*a* and 2*b* show dimension T and ribs 25.

Figure 3:
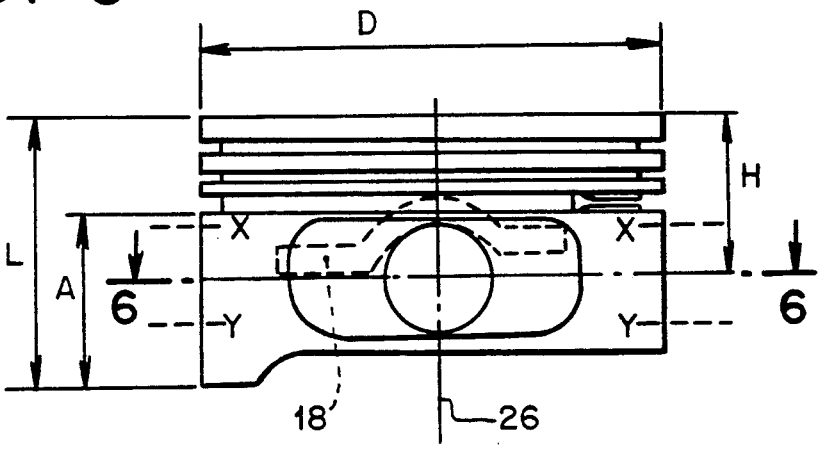
Figure 4:
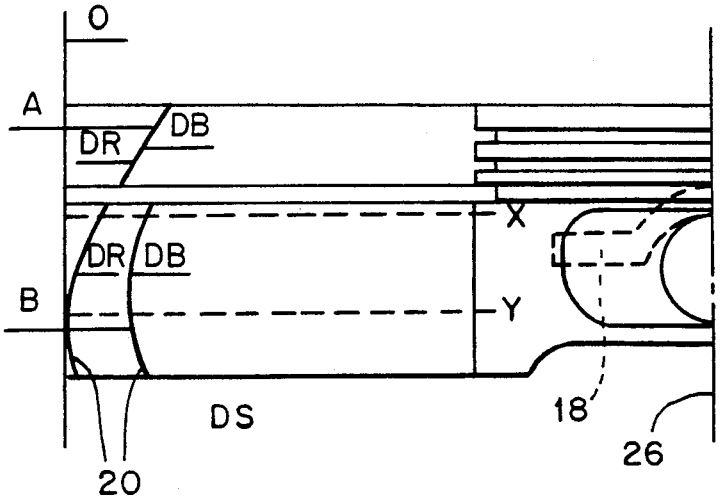
Figure 5:
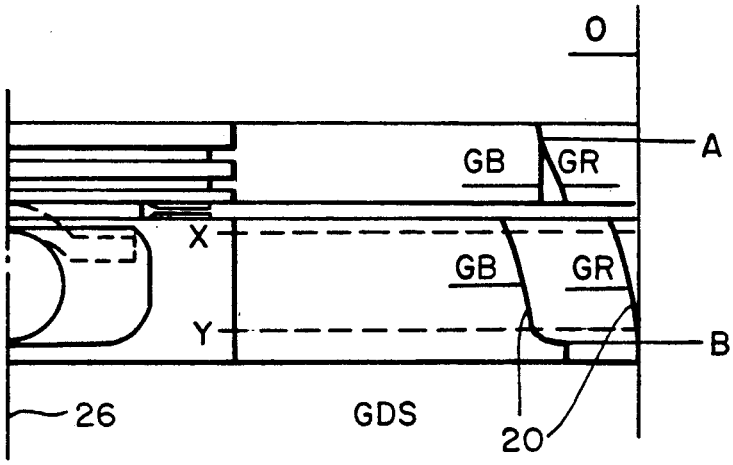
Figure 6:
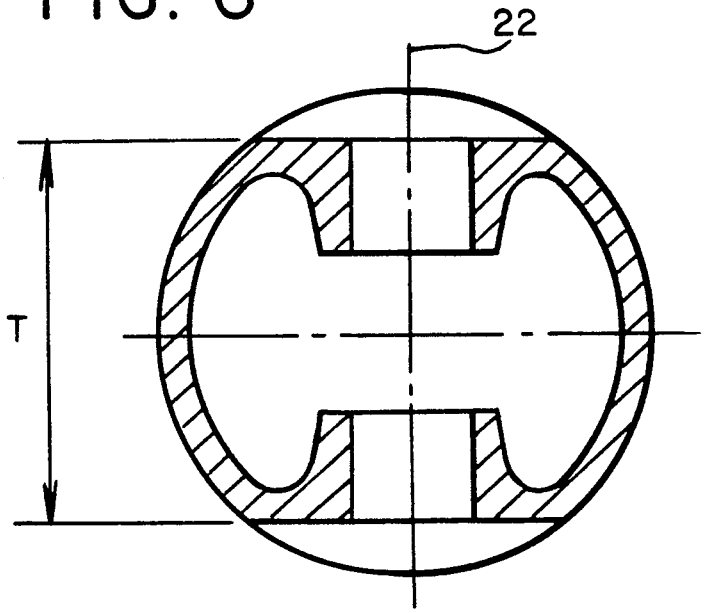

In FIGS. 4 and 5, with piston 10 according to FIG. 3, the curves DR and DB on major thrust face DS 12 as well as GR and GB on minor thrust face GDS 13 indicate a mantle line 20 progression. The straight lines 0 in FIGS. 4 and 5 indicate the cylinder contact path of piston 10. In the areas in which the curves DR or GR touch the straight line 0 in question, the play between piston skirt 11 and the cylinder contact surface is equal to zero. In general, the distance between the curves GR, GB, DR and DB on the one hand and the straight lines 0 on the other hand designates the play of the piston contact surface relative to the cylinder contact surface. FIGS. 3, 4 and 5 show distances L, D, H and A and piston axis direction 26. FIG. 6 shows distance T and pin axis direction 22.

Figure 7:
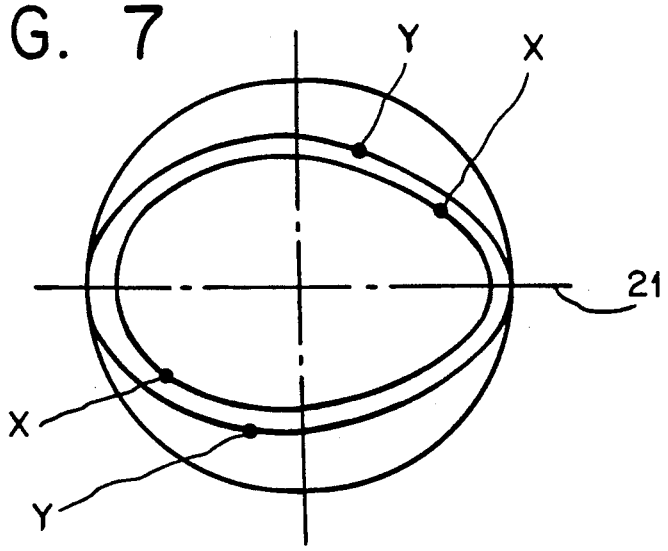

The curvature of the curves DR, DB and GR, GB corresponds to the outside shape of piston 10 in each case. As a comparison of the curves GR and DR shows, piston skirt 11 possesses a lesser bulge in the upper area of skirt 11 on minor thrust face GDS 13 than in the comparable area on major thrust face DS 12. The closer guidance on minor thrust face GDS 13 is possible due to the more resilient structure of piston skirt 11 overall on this piston side. The greater resilience is achieved, for one thing, with a horizontal slit 15 between skirt 11 and piston head 21, and, for another, with the greater ovality 21 of piston skirt 11 in the circumference direction, see FIG. 7. FIG. 7 also shows the polar plane cross sections at X and Y of FIGS. 3, 4 and 5. The resilience of piston skirt 11 on minor thrust face GDS 13 can be increased even further due to the fact that the thickness of skirt 11 is less there than in the corresponding area on major thrust face DS 12.

In order to be able to center piston 10 according to FIG. 3 both in the area of piston head 16 and the area of skirt 11, it is structured axially to be symmetrical on opposite sides, at levels A and B on its outside surface, at least in certain areas.

The expansion-controlling insertion strip 18 indicated with dot-dash lines in FIG. 3 lies higher towards the upper edge of skirt 11 axially on minor thrust face GDS 13 than on major thrust face DS 12.

FIGS. 1 and 2*b* show hubs 23 projecting into interior space 19 of piston 10 and proceeding from the bottom of piston 10 to hold a piston pin 24. Hubs 23 are supported against piston skirt 11 with radially progressing ribs 25. Ribs 25 located in the area of major thrust face DS 12 of piston 10 can be structured to be more massive and, therefore, stable, than the corresponding ribs 25 on minor thrust face GDS 13. It is also possible that such ribs 25 are applied only on major thrust face DS 12 with hubs 23 freely formed on the bottom of piston 10 for the remainder, while they can be entirely absent on minor thrust face GDS 13.

We claim:

1. A light plunger piston for internal combustion engines, especially gasoline engines for passenger automobiles, comprising a piston having a head with ring grooves, a skirt having hub bores and a pin, wherein

L/D=0.45–0.8

H/D=0.25–0.5

A/D=0.3–0.5

T/D=0.45–0.8 where

L=maximum length of the piston

D=maximum diameter of the piston

H=compression height

A = maximum skirt height below the bottom ring groove in a peripheral area having the approximate same skirt height of at least 45 degrees on the major thrust face of said piston with approximately symmetrical division of this area on both sides of a plane extending perpendicular to the pin axis and passing through the longitudinal axis of said piston, T = diametrically opposite distance between the hub bore ends located radially on the outside, and wherein said skirt bulging along the axis of the piston and having an oval cross-section, with the large diameter of the oval oriented perpendicular to the pin axis;

an axis of the hub bores being offset slightly towards the major thrust face;

said piston includes a horizontal slit, which separates the head from the skirt, located on the minor thrust face side of a plane extending through the longitudinal axis of said pin, and said piston;

said skirt having greater ovality on the minor thrust face side than on the major thrust face side in a polar plane perpendicular to the piston axis;

the minor thrust face side of said skirt being structured to bulge less in its upper area, adjacent to the bottom ring groove, than the major thrust face;

said skirt being longer on the major thrust face than on the minor thrust face; and the wall thickness of the piston on the major thrust face being greater than on the minor thrust face.

2. The plunger piston according to claim 1, additionally including a first expansion-controlling insert located in the area of the minor thrust face, said insert is formed as a strip extending in the direction of the skirt periphery and having a heat expansion coefficient which is less than that of said skirt.

3. The plunger piston according to claim 1, additionally including a second expansion-controlling insert located in the area of the major thrust face having a greater distance from the upper end of said skirt than said first insert.

* * * * *